US011830339B2

(12) United States Patent
Lincoln et al.

(10) Patent No.: US 11,830,339 B2
(45) Date of Patent: Nov. 28, 2023

(54) PORTABLE AUXILIARY DETECTION SYSTEM

(71) Applicant: CARRIER CORPORATION, Palm Beach Gardens, FL (US)

(72) Inventors: David L. Lincoln, Cromwell, CT (US); Marcin Piech, East Hampton, CT (US); Michael J. Birnkrant, Wethersfield, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 228 days.

(21) Appl. No.: 17/053,886

(22) PCT Filed: May 8, 2019

(86) PCT No.: PCT/US2019/031265
§ 371 (c)(1),
(2) Date: Nov. 9, 2020

(87) PCT Pub. No.: WO2019/217519
PCT Pub. Date: Nov. 14, 2019

(65) Prior Publication Data

US 2021/0248895 A1 Aug. 12, 2021

Related U.S. Application Data

(60) Provisional application No. 62/670,217, filed on May 11, 2018.

(51) Int. Cl.
*G08B 21/12* (2006.01)
*G08B 17/107* (2006.01)
(Continued)

(52) U.S. Cl.
CPC ..... *G08B 21/12* (2013.01); *G08B 17/107* (2013.01); *G08B 29/188* (2013.01); *G08B 25/10* (2013.01); *G08B 25/14* (2013.01)

(58) Field of Classification Search
None
See application file for complete search history.

(56) References Cited

U.S. PATENT DOCUMENTS 6,182,497 B1 2/2001 Krajci
7,333,129 B2 * 2/2008 Miller ..... G08B 29/188 348/162

(Continued)

FOREIGN PATENT DOCUMENTS

CN 201724919 1/2011
CN 202562903 11/2011

(Continued)

OTHER PUBLICATIONS

International Preliminary Report on Patentability for International Patent Application No. PCT/US2019/031265 completed Nov. 26, 2020.

(Continued)

*Primary Examiner* — Thomas S McCormack
(74) *Attorney, Agent, or Firm* — Carlson, Gaskey & Olds, P.C.

(57) ABSTRACT

A detection system includes a host detection system that has at least one primary hazard detector and a controller connected for communication with the at least one primary hazard detector. At least one portable auxiliary hazard detector can be temporarily introduced in a vicinity of the host detection system and link with the controller of the host detection system to provide additional detection capability. The portable auxiliary hazard detector has at least one light source that can emit a light beam, and at least one photosensor that is operable to emit sensor signals responsive to interaction of the light beam with an analyte.

25 Claims, 4 Drawing Sheets

(51) Int. Cl.

| | |
|---|---|
| ***G08B 29/18*** | (2006.01) |
| ***G08B 25/10*** | (2006.01) |
| ***G08B 25/14*** | (2006.01) |

(56) References Cited

U.S. PATENT DOCUMENTS

| | | | | |
|---|---|---|---|---|
| 9,677,327 | B1 * | 6/2017 | Nagel | G02F 1/163 |
| 9,680,271 | B2 | 6/2017 | Saari et al. | |
| 9,799,196 | B1 | 10/2017 | Boushehri et al. | |
| 2006/0176169 | A1 * | 8/2006 | Doolin | G08B 31/00 340/521 |
| 2008/0262321 | A1 * | 10/2008 | Erad | B01L 3/5027 422/52 |
| 2010/0098592 | A1 * | 4/2010 | Rong | G01N 21/55 422/82.11 |
| 2011/0201382 | A1 | 8/2011 | Hsiao | |
| 2013/0271286 | A1 * | 10/2013 | Quan | H04Q 9/00 340/691.6 |
| 2014/0313040 | A1 * | 10/2014 | Wright, Sr. | G09B 21/009 340/628 |
| 2015/0022367 | A1 * | 1/2015 | Matsuoka | G08B 17/10 340/692 |
| 2017/0248514 | A1 | 8/2017 | Pavey et al. | |

FOREIGN PATENT DOCUMENTS

| | | | |
|---|---|---|---|
| CN | 102347061 | 2/2012 | |
| CN | 103808910 | 5/2014 | |
| CN | 105096535 | 11/2015 | |
| CN | 205080714 | 3/2016 | |
| DE | 102014019773 | 6/2016 | |
| JP | 2010025728 | 2/2010 | |
| JP | 2015069626 | 4/2015 | |
| JP | 2015095754 | 5/2015 | |
| JP | 2016197016 | * 11/2016 | G01N 21/41 |
| WO | 2017218763 | 12/2017 | |

OTHER PUBLICATIONS

International Search Reprot & Written Opinion for International Application No. PCT/US2019/031265 completed Aug. 6, 2019.

Liu, Y., Liu, Q., Chen, S., Cheng, F., Wang, H., and Peng, W. (2015). Surface plasmon resonance biosensor based on smart phone platforms. Scientific Reports. Aug. 10, 2015. https://www.ncbi.nlm.nih.gov/pmc/articles/PMC4542615/.

OMNI Instruments. PS500 Multi Gas Detector. Retrieved from: https://www.omniinstruments.co.uk/pb-ps500.html.

Kingmax. AirQ Check GS-01 [Tvoc Mobile Health Device]. Retrieved from: http://www.kingmax.com.tw/en-global/product/product/Model/AirQ_Check.

AZO Sensors. Detective VOCs to determine air quality. Retrieved from: https://www.azosensors.com/article.aspx?ArticleID=579.

RLE Technologies. RLE SeaHawk. F200.

* cited by examiner

PORTABLE AUXILIARY DETECTION SYSTEM

CROSS-REFERENCE TO RELATED APPLICATION

This application claims benefit of U.S. Provisional Application No. 62/670,217 filed May 11, 2018.

BACKGROUND

Detection systems are often installed in homes, office buildings, airports, sports venues, and the like to identify smoke or chemicals for early warning of a threat event. As examples, systems may be designed to identify trace amounts of smoke particles as an early warning of a fire, trace amounts of a target chemical as an early warning of toxicity of an environment, or minute amounts of airborne substances during security screening of humans, luggage, packages, or other objects.

SUMMARY

A detection system according to an example of the present disclosure includes a host detection system that has at least one primary hazard detector and a controller connected for communication with the at least one primary hazard detector, and at least one portable auxiliary hazard detector that can be temporarily introduced in a vicinity of the host detection system and link with the controller of the host detection system to provide additional detection capability. The at least one portable auxiliary hazard detector has at least one light source. Each said light source, when operated, emits a light beam. At least one photosensor is operable to emit sensor signals responsive to interaction of the light beam with an analyte.

A further embodiment of any of the foregoing embodiments includes a surface plasmon sensor operable to emit second sensor signals responsive to interaction of the light beam with the surface plasmon sensor.

In a further embodiment of any of the foregoing embodiments, the surface plasmon sensor includes a prism.

A further embodiment of any of the foregoing embodiments includes a beam splitter operable to split the light beam into first and second secondary light beams. The first secondary light beam is directed at the prism and the second secondary light beam is directed external to the at least one portable auxiliary hazard detector.

In a further embodiment of any of the foregoing embodiments, the at least one light source includes an ultraviolet light source and a visible light source.

A further embodiment of any of the foregoing embodiments includes a wireless transmitter operable to transmit the sensor signals to the controller.

A further embodiment of any of the foregoing embodiments includes a universal serial bus (USB) connector and a circuit board connected with the USB connector. The at least one light source and the at least one photosensor are mounted on the circuit board.

A further embodiment of any of the foregoing embodiments includes a surface plasmon sensor mounted on the circuit board and operable to emit second sensor signals responsive to interaction of the light beam with the surface plasmon sensor.

A further embodiment of any of the foregoing embodiments includes a waterproof casing enclosing the at least one light source and the at least one photosensor.

A detector according to an example of the present disclosure includes a portable auxiliary hazard detector that can be temporarily introduced in a vicinity of a host detection system and link with a controller of the host detection system to provide additional detection capability. The portable auxiliary hazard detector has at least one light source. Each said light source, when operated, emits a light beam. At least one photosensor is operable to emit sensor signals responsive to interaction of the light beam with an analyte.

A further embodiment of any of the foregoing embodiments includes a surface plasmon sensor operable to emit second sensor signals responsive to interaction of the light beam with the surface plasmon sensor.

A further embodiment of any of the foregoing embodiments includes a beam splitter operable to split the light beam into first and second secondary light beams. The first secondary light beam is directed at the prism and the second secondary light beam is directed external to the at least one portable auxiliary hazard detector.

A further embodiment of any of the foregoing embodiments includes a universal serial bus (USB) connector and a circuit board connected with the USB connector. The at least one light source, the at least one photosensor, and the surface plasmon sensor are mounted on the circuit board.

The detector as recited in claim 10, wherein the at least one light source includes an ultraviolet light source and a visible light source.

A further embodiment of any of the foregoing embodiments includes a wireless transmitter operable to transmit the sensor signals to the controller.

A further embodiment of any of the foregoing embodiments includes a waterproof casing enclosing the at least one light source and the at least one photosensor.

A detector according to an example of the present disclosure includes a universal serial bus (USB) connector, a circuit board connected with the USB connector, and at least one light source mounted on the circuit board. Each said light source, when operated, emits a light beam, and at least one photosensor mounted on the circuit board, each said photosensor operable to emit sensor signals responsive to interaction of the light beam with an analyte.

A further embodiment of any of the foregoing embodiments includes a surface plasmon sensor mounted on the circuit board and operable to emit second sensor signals responsive to interaction of the light beam with the surface plasmon sensor, and a beam splitter operable to split the light beam into first and second secondary light beams. The first secondary light beam is directed at the prism and the second secondary light beam is directed external to the at least one portable auxiliary hazard detector.

In a further embodiment of any of the foregoing embodiments, the at least one light source includes an ultraviolet light source and a visible light source, and further includes a wireless transmitter mounted on the circuit board and operable to transmit the sensor signals to the controller.

A further embodiment of any of the foregoing embodiments includes a waterproof casing enclosing the at least one light source and the at least one photosensor.

A method according to an example of the present disclosure includes introducing a plurality of portable auxiliary hazard detector into a region and linking the portable auxiliary hazard detectors with a controller to provide detection capability in the region. Each said portable auxiliary hazard detector has at least one light source. Each said light source, when operated, emits a light beam. At least one photosensor is operable to emit sensor signals responsive to interaction of the light beam with an analyte, and determines whether a target species is present in the analyte based the sensor signals.

In a further embodiment of any of the foregoing embodiments, the determining whether the target species is present in the analyte is based on an aggregate of the sensor signals from at least two of the portable auxiliary hazard detectors.

A further embodiment of any of the foregoing embodiments includes comprising determining whether the target species is moving or spreading based on the sensor signals.

A further embodiment of any of the foregoing embodiments includes changing operation of a heating, ventilation, and air conditioning system in the region based upon a determination that the target species is present.

A further embodiment of any of the foregoing embodiments includes determining a chemical identity of the target species from a spectrum using the sensor signals of one of the detectors, and verifying the chemical identity by comparing the spectrum to another spectrum from the sensor signals of another of the detectors.

A further embodiment of any of the foregoing embodiments includes determining whether there is a trend of increasing concentrations of the target species across two or more of the detectors, and triggering an alarm is there is the trend.

A further embodiment of any of the foregoing embodiments includes determining a mean value and variability of a concentration of the target species across the detectors based on an aggregate distribution of the sensor signals, and triggering an alarm if both the mean value and the variability increase.

A further embodiment of any of the foregoing embodiments includes increasing a sampling rate in one of the portable auxiliary hazard detectors based on a determination from another of the portable auxiliary hazard detectors that the target species is present.

A further embodiment of any of the foregoing embodiments includes increasing the sampling rate only in one or more of the portable auxiliary hazard detectors that are nearest to the portable auxiliary hazard detector that detected the target species. One or more of the portable auxiliary hazard detectors that are remote do not change sampling rate.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Detection systems in homes, office buildings, airports, sports venues, and the like identify smoke or chemicals for early warning of a threat event. Such a system may have limited capability. For example, the system is limited to the capability of its existing detectors and although the system may continue to operate during a threat event, once the threat event is identified the system may have limited capability for enhanced analysis as the threat event unfolds. Disclosed herein is a portable auxiliary detection system that can be added to a host detection system in order to augment detection capability prior to or during the threat event.

Figure 1:
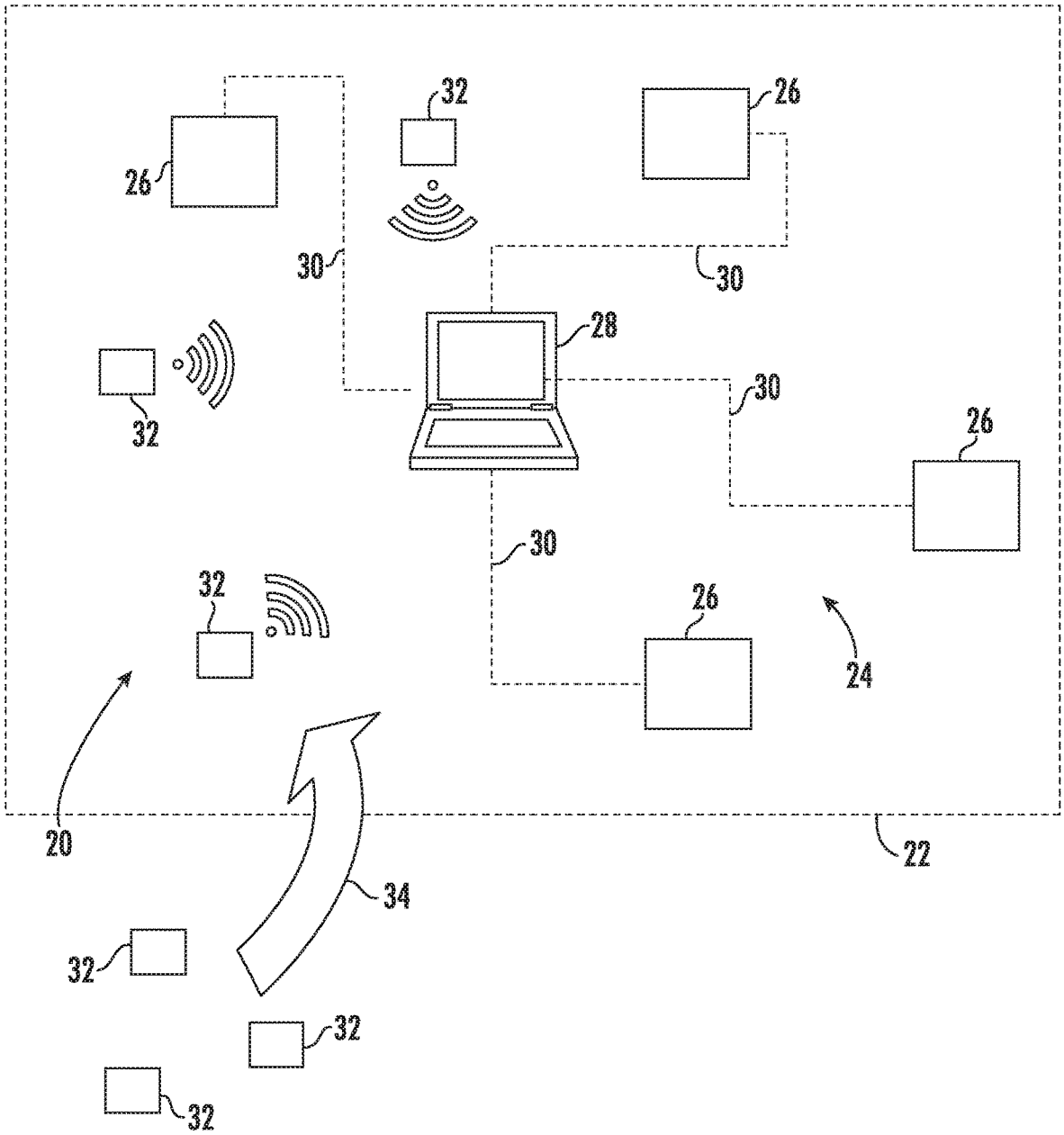
FIG. 1 illustrates an example detection system that has at least one portable auxiliary hazard detector.

FIG. 1 schematically illustrates an example detection system 20 ("system 20") for monitoring an analyte in region 22 for hazardous materials. For example, the region 22 may be, but is not limited to, buildings, airports, sports venues, and the like. The hazardous material may be smoke, other particulate, chemicals, biological agents, one or more target species, or other materials that may be indicative or subject of a threat event.

In this example, the system 20 includes a host detection system 24 that includes at least one primary hazard detector 26 ("detectors 26") and a controller 28. The controller 28 is communicatively connected for communication with the detectors 26 via connections 30. It is to be understood that communicative connections or communications herein can refer to optical connections, wire connections, wireless connections, or combinations thereof. The controller 28 may include hardware (e.g., one or more microprocessors and memory), software, or both, that are configured (e.g., programmed) to carry out the functionalities described herein.

The detectors 26 may be, but are not limited to, smoke detectors or indoor air quality sensors that are capable of detecting small amounts of particulate (e.g., smoke particles, dust steam, or other particulate), chemicals, and/or biological agents in the analyte. Example types of detectors 26 may include ionization detectors, photoelectric aspirating detectors, photoelectric chamber or chamber-less detectors, electrochemical sensors, surface plasmon resonance sensors, photoacoustic detectors, and combinations thereof.

As an example, the host detection system 24 is a permanent installation of the region 22. In this regard, at least portions of the detection system 24 may include hardware that is structurally integrated into the region 22. For instance, the detectors 26 may be hardwired through a building or location infrastructure and/or the detectors 26 may be installed via building-integrated hardware or infrastructure that is structurally adapted to house or mount the detectors 26. Although FIG. 1 includes elements of system 20 within region 22, some of the elements of system 20 may be located adjacent or outside of the region 22, provided their proximity to the analyte in the region 22 is not required to enable the method and configuration described herein. For example, as described herein some or all of the detectors typically are integrated in the region, but the controller 28 may be adjacent to or outside of the region 22 provided that it is in communication range of the detectors 26.

The host detection system 24 may generally be configured as an early warning system to identify the presence of the hazardous material and trigger an alarm. For instance, the detectors 26 monitor the air for the presence of smoke, other particulate, chemicals, and/or biological agents, and the controller 28 triggers an alarm upon determination that smoke, other particulate, chemicals, and/or biological agents is/are present in the air. The controller 28 may also be configured to control other systems in a building or location infrastructure, such as but not limited to, heating, ventilation and air conditioning (HVAC) systems.

The host detection system 24 is limited in that it contains a finite number of the detectors 26 that have established detection capabilities. For instance, the detectors 26 may all be smoke detectors that are incapable of identifying chemicals or biological agents, or the detectors 26, after smoke is detected, may not provide further useful data.

In this regard, the system 20 includes one or more portable auxiliary hazard detectors 32 ("detectors 32"). The detectors 32 can be temporarily introduced (as represented at 34) in the vicinity of the host detection system 24 (e.g., in or near the region 22 and within communication range of the controller 28) to provide additional detection capability. For instance, the detectors 32 may be added to the host detector system 24 to augment detection analysis capability during a threat event once smoke, chemicals, or biological agents have already been detected in the region 22. Such a use may facilitate management of people and resources at the region 22 during the threat event, and the detectors 32 may afterwards be removed from the system 20 while the host detection system 24 resumes operation. As another example, the detectors 32 can be added to the host detector system 24 prior to any threat event, to augment detection analysis capability for indication of a threat event. In this case, the detectors 32 may be used to temporarily boost capability, such as at a sporting event or other gathering of people, and the detectors 32 may afterwards be removed from the system 20 while the host detection system 24 continues operation. In an additional example, the detectors 32 may be deployable as above, or alternatively used as a stand-alone detection system.

The detectors 32 are compact and portable, and are not hardwired to the controller 28. The detectors 32 can easily carried by hand into the region 22 and temporarily placed in the region 22. As an example, the "portable" nature of the detectors 32 refers to a detector 32 having greater portability than a detector 26. For instance, the detector 26 is typically invasively mounted on a structure in the region 22, such as by a plurality of fastener screws and corresponding holes in the structure (a "destructive" installation that requires a permanent alteration to the structure of the region 22). However, the detector 32 is non-invasively placed in the region 22 without any fastener screws or need for holes (a "non-destructive" installation that does not require a permanent alteration to the structure of the region 22). The detectors 32 may thus be freely moved and placed to operate from virtually anywhere in the region 22, i.e., unlike the detectors 26 the detectors 32 are not location-fixed in the region 22.

Upon activation (e.g., powering or turning the devices ON) the detectors 32 link with the controller 28 of the host detection system 24 to provide detection capability in addition to the detectors 26, such as but not limited to, chemical detection, chemical identification, smoke detection, biological agent detection, and combinations thereof. For instance, controller 28 may utilize data collected from the detectors 26, which will be described in further detail below.

Figure 2:
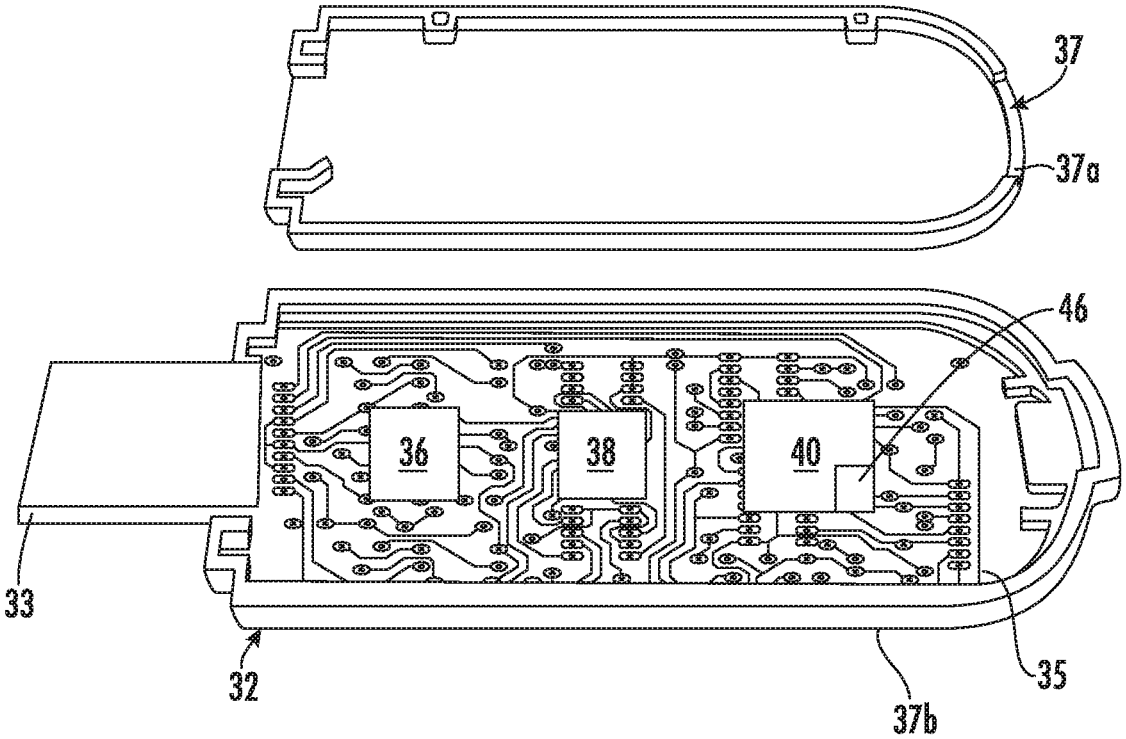
FIG. 2 illustrates an example portable auxiliary hazard detector.
Figure 3:
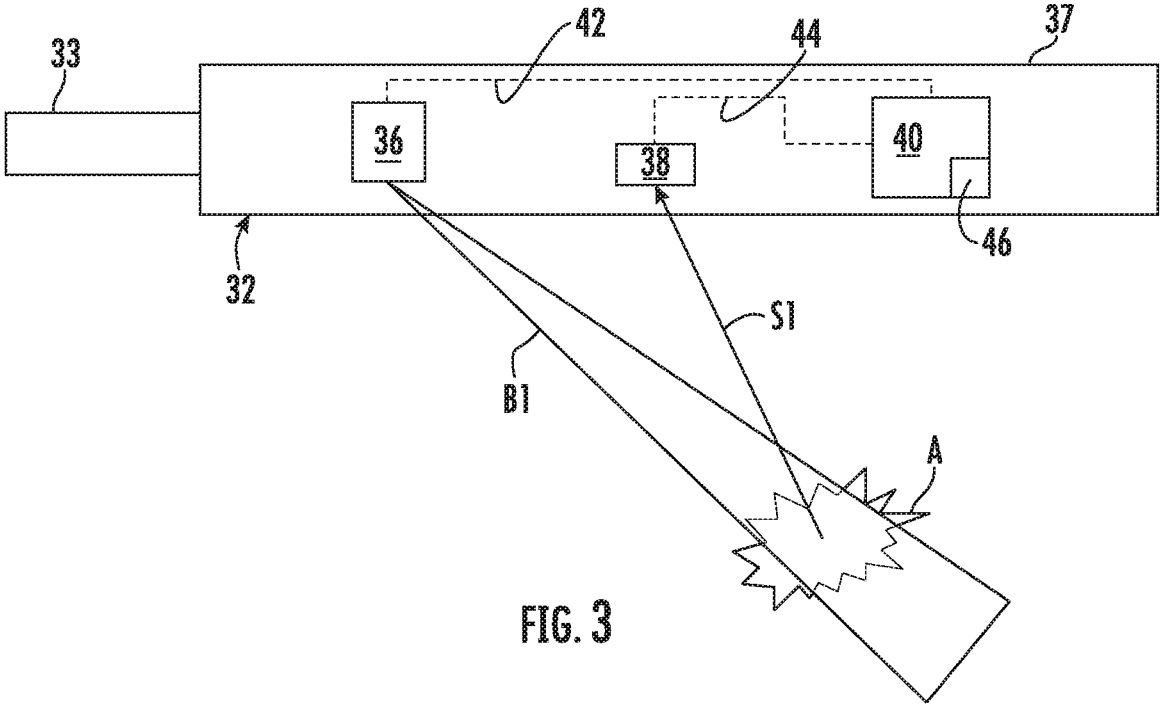
FIG. 3 illustrates the portable auxiliary hazard detector of FIG. 2.

FIG. 2 illustrates a representative example of one of the detectors 32, which is also shown in a side view in FIG. 3. In this example, the detector 32 is on a Universal Serial Bus (USB) platform and includes a USB connector 33 and a circuit board 35. In this regard, the detector 32 may be a "plug and play" device that, once introduced into the vicinity of the host detection system 24 by plugging in (to power the detector 32), can be discovered by the host detection system 24 without the need for physical device configuration or user intervention.

The detector 32 has at least one light source 36 and at least one photosensor 38 that are operably mounted on the circuit board 35. The circuit board 35, light source(s) 36 and photosensor(s) 38 are enclosed in a casing 37, which may include top and bottom casing pieces that are attached together; casing 37 may be waterproof such that casing pieces 37*a*, 37*b* are sealed together. The case may include a visual indicator such as a light or small LCD screen (not shown) communicatively connected to the controller 40 to indicate a status of the detector 32, such as power status of the device, sensor readings, communication status, and other indications of detector operation. The detector 32 may also include other sensors, such as a temperature sensor, a humidity sensor, or the like. The detector 32 may be powered through the USB connector 33 and thus may exclude an onboard battery. Alternatively, the detector 32 may be a self-contained device that has an onboard battery and does not have the USB connector 33.

Each light source 36, when operated, emits a light beam B1 (FIG. 3). The detector 32 may further include a control module 40 and each light source 36 may be communicatively connected at 42 to the control module 40. The control module 40 may include hardware (e.g., one or more microprocessors and memory), software, or both, that are configured (e.g., programmed) to carry out the functionalities described herein for the detector 32. As an example, the control module 40 may be configured with the same communication protocol as the host detector system 24, such as but not limited to BACnet. The control module 40 may also include a global positioning system (GPS) receiver, to enable the controller 28 to know the location of each detector 32. Additionally or alternatively, the controller 28 may utilize triangulation in a local area wireless network to locate each detector 32. As another alternative, the locations of the detectors 32 may be manually input into the controller 28.

The light source 36 is communicatively connected with the control module 40 such that the control module 40 can control operation of the light source 36 with regard to OFF/ON, varying light intensity (power or energy density), varying light wavelength, and/or varying pulse frequency. As an example, the light source 36 is a light emitting diode or laser that can emit a light beam at a wavelength or over a range of wavelengths that may be altered in a controlled manner. Moreover, at each wavelength, the light intensity and/or pulse frequency can be varied in a controlled manner. For instance, the control module 40 can scan the analyte across ranges of wavelengths, intensities, and/or pulse frequencies by controlling the light source 36. In another example, one or more light sources 36 emits light in the wavelength range of 250 nm to 532 nm, 400 nm to 1100 nm or 900 nm to 25000 nm. The wavelength range can be adjusted by a filter or a light source 36 can be chosen to generate light with a 100 nm or less spectral width that falls within the wavelength range. The light source can also be controlled to generate multiple discrete wavelengths that are matched to the target species to improve sensitivity and selectivity. As used herein, "light" may refer to wavelengths in the visible spectrum, as well near infrared and near ultraviolet regions.

Each photosensor 38 is communicatively connected at 44 to the control module 40. Each photosensor 38 is operable to emit sensor signals responsive to interaction of the light beam B1 with the analyte, which here is represented at A.

The photosensor 38 may be a solid state sensor, such as but not limited to, photodiodes, bipolar phototransistors, photosensitive field-effect transistors, and the like. The photosensor 38 is responsive to received scattered light S1 from interaction of the light beam B1 with the analyte A. The sensor signals are proportional to the intensity of the scattered light S1 received by the photosensor 38.

The sensor signals may be saved in a memory in the control module 40 and/or transmitted via a transmitter 46 to the controller 28 of the host detection system 24. The control module 40, the controller 28, both, or combinations of the control module 40 and the controller 28 may determine whether a hazardous material is present in the analyte based on an intensity of the scattered light. If the light source 36 is capable of scanning over a range of wavelengths, the control module 40, the controller 28, both, or combinations of the control module 40 and the controller 28 may also determine a chemical identity of the contaminant from a spectrum of the scattered light over the range of wavelengths. These two determinations may be referred to herein as, respectively, a presence determination and an identity determination.

A presence determination can be made by analyzing the intensity of the sensor signals. For instance, when no material is present, the sensor signals are low. This may be considered to be a baseline or background signal. When a material is present and scatters light, the sensor signals increase in comparison to the baseline signal. Higher amounts of material produce more scattering and a proportional increase in the sensor signal. An increase that exceeds a predetermined threshold serves as an indication that the material is present.

An identity determination can be made by analyzing the sensor signals over the range of wavelengths of the light beam B1. For instance, the analyte is scanned over the range of wavelengths to collect temporal spectra of intensity versus wavelength (or equivalent unit). Different materials respond differently with regard to absorbance and scattering of different wavelengths of light. Thus, the spectra of different types of contaminants (taking into account a baseline or background spectra) differ and can be used as a signature to identify the type of contaminant by comparison of the spectrum with a spectra library or database, which may be in the memory of the control module 40 and/or controller 28. In this manner, the chemical identity of the material can be determined, such as but not limited to, carbonyls, silanes, cyanates, carbon monoxide, and hydrocarbons.

The control module 40 can also be configured for ad-hoc communication capability (such as ad-hoc wifi, proprietary wireless protocol, or Bluetooth, or a combination, for example) with the transmitter 46. The ad-hoc capability utilizes processing resources within a detector 32 to aggregate data from other detectors 32. The aggregated data is evaluated to confirm the alarm decision of the detector 32. In an example, an evolving plume of bio-particles is detected by detector 32, but is not detected by surrounding detectors 32. An alarm with low confidence rating may be issued (i.e., a low alarm). As more detectors 32 detect the evolving plume of bio-particles the alarm confidence increases and the alarm level will increase resulting in a high alarm. The alarm levels may indicate what response or notification is triggered. A low alarm level may notify a security guard, or automatically change the HVAC system to ventilate the area. A high alarm response may initiate evacuation notification of the building, area or room. For example, ad-hoc communication capability enables the detector 32 to communicate with the controller 28 of the host detection system 24, with other detectors 32, or with another controller if in a standalone system.

In a further example, the detector 32 also employs a low-power scheme. In one example low power scheme, the detectors 32 operate at a low sample rate. For instance, the sample rate may take one sample reading every 10-60 seconds. If one of the detectors 32 detects presence of a target species, the detector 32 may responsively begin sampling at a higher sample rate. An example high sample rate is one sampling per second. If that detector 32 still continues to detect the presence of the target species at the high sampling rate, it may send an alarm signal to the other detectors 32. The alarm signal triggers the other detectors 32 to go into the high sample rate, to help confirm the presence of the target species and provide information about where the target species is present. In one additional example, rather than all of the detectors 32 going into the high sample rate, only the nearest detectors 32 detectors go into a high sample rate such that at least one or two more remote detectors 32 do not go into the high sample rate.

In another example, the detectors 32 are used to increase sensitivity using data fusion. For instance, if one of the detectors 32 detects presence of a target species, but the concentration of the target species does not exceed an alarm threshold for an individual detector, that detector 32 may trigger other detectors, or at least nearby detectors 32, to go into the high sample rate. This, in turn, increases sensitivity through collection of more data from more detectors 32. Multiple detectors 32 then operating at the high sample rate may also detect the presence of the target species at a concentration that does not exceed the alarm threshold for an individual detector. The controller 28 monitors for this condition and, if it occurs, triggers an alarm.

Figure 4:
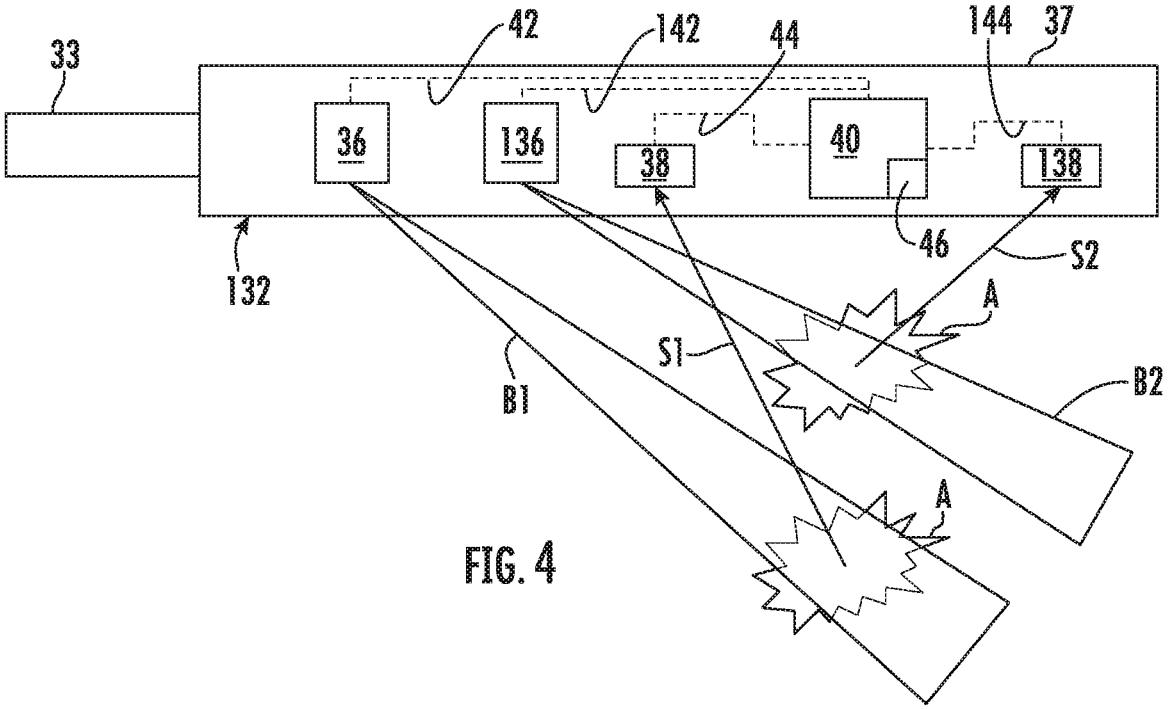
FIG. 4 illustrates another example portable auxiliary hazard detector that has multiple light sources and photosensors.

FIG. 4 illustrates another example portable auxiliary hazard detector 132. In this disclosure, like reference numerals designate like elements where appropriate and reference numerals with the addition of one-hundred or multiples thereof designate modified elements that are understood to incorporate the same features and benefits of the corresponding elements. In this example, the detector 132 includes an additional light source 136 communicatively connected at 142 with the control module 40 and an additional photosensor 138 communicatively connected at 144 to the control module 40.

The light source 136, when operated, emits a light beam B2, which may be directed at a different angle from the detector 132 than the angle of the light beam B1 from the light source 36. As an example, the light source 136 is a light emitting diode or laser that can emit a light beam at a wavelength or over a range of wavelengths. Moreover, at each wavelength, the light intensity and/or pulse frequency can be varied in a controlled manner. For instance, the control module 40 can scan the analyte across ranges of wavelengths, intensities, and/or pulse frequencies by controlling the light source. In another example, the light source 136 is capable of producing ultraviolet light, which enables biochemical detection and fluorescent spectroscopy.

The photosensor 138 may be a solid state sensor, such as but not limited to, photodiodes, bipolar phototransistors, photosensitive field-effect transistors, and the like. The photosensor 138 is responsive to received forward-scattered light S2 from interaction of the light beam B2 with the analyte A. The sensor signals are proportional to the intensity of the scattered light S2 received by the photosensor 138. The photosensors 138 can also have wavelength dependence to only accept light at certain wavelength bands. This functionality may be built into the sensing elements of the photosensor 138, or alternatively a filter can be placed in front of the photosensor 138. For example, for fluoresce measurement, the light is emitted at wavelength range A, but the photosensor 138 may only detect light at wavelength range B, which may or may not overlap range A.

The control module 40, the controller 28, or both may be configured to compare the sensor signals from the photosensors 38, 138 to identify information about the analyte or identify a fault condition. For instance, the light sources 36, 136 may be operated at different wavelengths or frequencies to enhance identification of a hazardous material. As an example, rather than a single signature spectra of light scatter, the light source 136 and photosensor 138 can provide a second signature spectra at a different frequency, wavelength, frequency range, or wavelength range, which may be used to distinguish hazardous materials that may otherwise have similar spectra, distinguish between smoke particles, dust, and steam, or determine particle size.

In a further example, the sensor signals may be used to identify a fault condition in which there is an obstruction (e.g., a hand) in the lines of the light beams B1, B2 that is not a hazardous material. For instance, such an obstruction may fully or nearly fully block forward-scatter to the photosensor 138 but produce scatter to the photosensor 38. This situation may be identified and trigger a fault condition in the control module 40, controller 28, or both, to ignore the reading as an obstruction instead of hazardous material.

Figure 5:
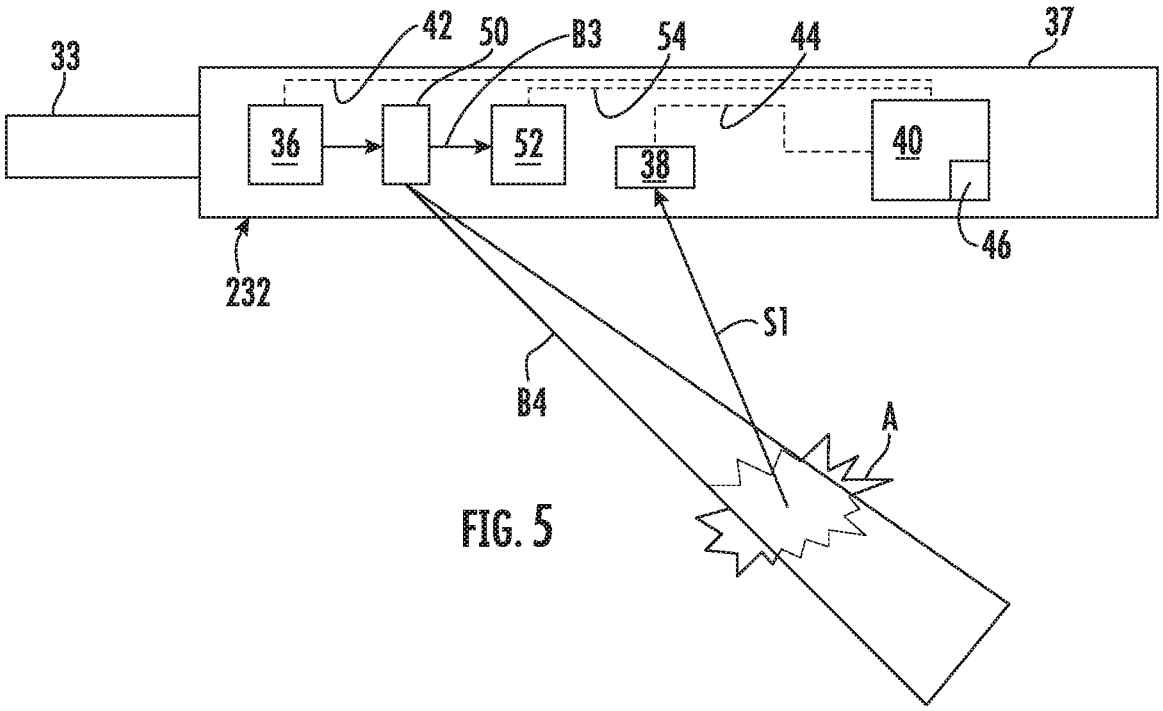
FIG. 5 illustrates another example portable auxiliary hazard detector that has a surface plasmon sensor.

FIG. 5 illustrates another example portable auxiliary hazard detector 232. In this example, the detector 232 includes a beam splitter 50 and a surface plasmon sensor 52. The beam splitter 50 is operable to split the light beam B1 into first and second secondary light beams B3 and B4. The first secondary light beam B3 is directed at the surface plasmon sensor 52 and the second light beam B4 is directed external to the detector 232. The surface plasmon sensor 52 is communicatively connected at 54 to the control module 40 and is operable to emit sensor signals responsive to interaction of the light beam B3 with the surface plasmon sensor 52. Similar to the above examples, the photosensor 38 is responsive to received forward-scattered light S1 from interaction of the light beam B4 with the analyte A.

Figure 6:
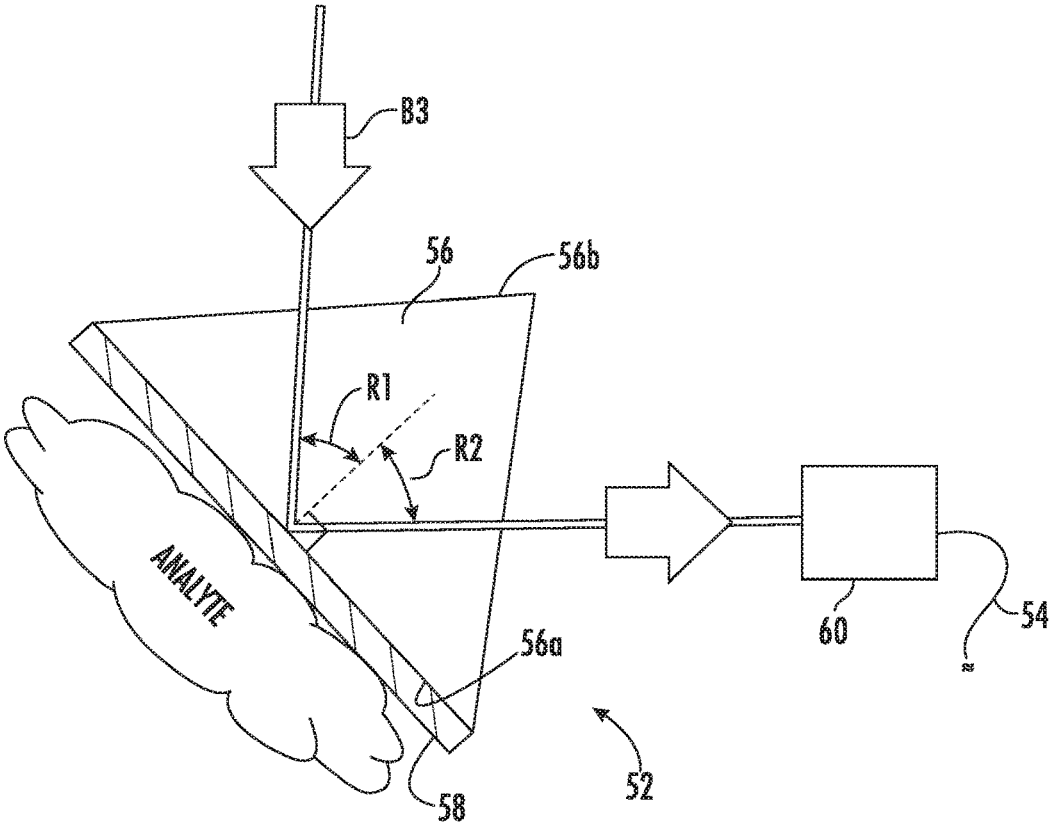
FIG. 6 illustrates an example surface plasmon sensor.

FIG. 6 illustrates an example of the surface plasmon sensor 52. The surface plasmon sensor 52 includes a prism 56 that is coated on a first face 56*a* with a thin metal film 58, such as a gold or silver coating. The prism 56 is situated to reflect the light beam B3 to a photosensor 60.

The metal film 58 is exposed to the analyte. The light beam B3 enters the prism 56 through a second face 56*b* and propagates at an angle of incidence R1 toward the interface of the prism 56 with the metal film 58. The light beam B3 reflects off of the interface at a resonance angle R2. The light beam B3 excites surface plasmon polaritons in the metal film 58. If the analyte contains a hazardous material, the material interacts with the surface of the metal film 58, thereby locally changing the plasmon response and the resultant resonance angle R2. The photosensor 60 is used to monitor the resonance angle R2 and emit the sensor signals to the control module 40. As will be appreciated, surface plasmon resonance and devices are known and other types of surface plasmon sensors and techniques may be used.

The surface plasmon sensor 52 may serve to independently identify faulty determinations made from the photosensor 38 of whether a hazardous material is present in the analyte. As an example, if the sensor signals of the surface plasmon sensor 52 exceed a threshold above a background signal, a positive presence determination is made that the hazardous material is present. This positive presence determination can then be compared to the presence determination made from the sensor signals of the photosensor 38 to identify whether there is a fault. If there is a negative presence determination from the photosensor 38 but a positive presence determination from the surface plasmon sensor 52, a fault can be triggered. If there is a positive presence determination from the photosensor 38 but a negative presence determination from the surface plasmon sensor 52, a fault can be triggered and generate a notification signal. The surface plasmon sensor 52 thus provides a level of redundancy to the photosensor 38.

In a further example, the surface plasmon sensor 52 can also serve to distinguish a chemical identity of the hazardous material based on a distinct signature across the photosensor 38 and surface plasmon sensor 52. For instance, hazardous material, such as but not limited to, hydrogen sulfide ($H_2S$) may have close chemical analogs that produce similar but not identical responses in the photosensor 38 and the surface plasmon sensor 52. To distinguish the analogs, the responses across the photosensor 38 and the surface plasmon sensor 52 are compiled to produce a signature thumbprint for each analog. The signatures of the analogs can then be compared to a library of signatures to identify which analog the hazardous material is. Additionally or alternatively, the responses across the photosensor 38 and the surface plasmon sensor 52 can be input into a neural network in the control module 40 or host detection system 24 to build a foundation for identifying and distinguishing analogs.

The following examples demonstrate control strategies of the detectors 32/132/232. The examples will refer only to the detectors 32, but it is to be understood that the examples are also applicable to the detectors 132/232. Unlike a single detector or groups of detectors that more or less serve individually, the detectors 32 provide a group control strategy that may enhance early detection and threat event responsiveness.

In one example, the detectors 32 serve as a group, i.e., a detection network, to identify and track detected species. For instance, if one of the detectors 32 identifies a target species (e.g., smoke), in response the controller 28 may determine whether any other of the detectors 32 also have identified the target species. If no other detector 32 identifies the target species, there is a low confidence level of the presence of the target species. As a result, the controller 28 may take no action or, depending on system alarm settings, may trigger a low level alarm. However, if one or more additional detectors 32 also identifies the target species, there is a higher confidence level that the target species is present. In response, the controller 28 may trigger an alarm and/or take responsive action. An example action is to command one or more changes in the HVAC system of the building or location infrastructure. For instance, dampers may be moved from open to closed states and/or fans and compressors may be deactivated, to reduce the ability of the target species to spread.

In a further example, the detectors 32 are used as a group to provide a two-prong detection strategy—one based on high concentration limits and another based on trending detection in the detectors 32. In the first approach (high concentration), there is an alarm level for concentration of the target species at any one of the detectors 32. If the level is exceeded at any one of the detectors 32, the controller 28 triggers an alarm. Although not limited, an alarm may be set from the sensor signals. For instance, the intensities of the sensor signals are representative of the concentration of the target species in the region 22. The controller 28 statistically aggregates the sensor signals and produces a distribution across all of the detectors 32. An alarm level for high concentration may be set with regard to a mean value of the distribution (e.g., a multiple of the statistical standard deviation for the distribution). Thus, if the concentration of the target species at any one of the detectors 32 were to exceed the alarm limit, the controller 28 would trigger an alarm.

In the second approach (trending detection), the controller 28 looks for increases in concentration of the target species across two or more of the detectors. In this approach a threat event is identified based on trending, but prior to the concentration reaching the high levels that would trigger the alarm under the first approach above. For instance, controller 28 may identify an increase in concentration at one of the detectors 32 and, within a preset time period of that, identify an increase in concentration at one or more other detectors 32. Thus, across a time period, the controller 28 identifies a progressive increases in the number of the detectors 32 that have increasing concentrations. The time period may be varied, but in one example may be a relatively short time on the order of about one second to about 1000 seconds, which is designed to address relatively rapidly unfolding/spreading threat events.

Upon identifying this progressive increase in the number of the detectors 32 that have increasing concentrations (but are below the alarm limit above), the controller 28 may take no response, trigger a low level alarm, or trigger a high level alarm. In one example, the decision tree for this response is based on the number of detectors 32 that have increasing concentrations. For instance, if only a single detector 32 has increasing concentration, the controller 28 takes no action. If two to four detectors have increasing concentrations, the controller 28 triggers a low level alarm. And if more than four detectors 32 have increasing concentrations, the controller 28 triggers a high level alarm. As will be appreciated, the numbers of detectors 32 that trigger these various responses can be varied. In other words, the controller 28 can be configured or programmed to select a response that depends on the number of detectors 32 that have increasing concentrations that are under the alarm limit of the first approach from above.

There is an additional, third approach that may be used with the above approaches or in place of either of the above approaches. This third approach is somewhat similar to the second approach in that it is also based on trending prior to the concentration reaching the high levels that would trigger the alarm under the first approach above. In the third approach the controller 28 looks for one or more particular trends over time in the mean value of the distribution taken from the statistical aggregate of the sensor signals of the detectors 32. Most typically, the time period here would be longer than the time period above for the second approach, as the approach here is intended to discriminate slow-moving events. For instance, the controller 28 identifies whether the mean and the variability of the distribution changes over time (e.g., over a period of more than about 15 min up to several days or weeks) and, based on the outcomes, discriminates between different types of events.

The following scenarios demonstrate two examples of the third approach, the first of which is an event that is not a threat and the second of which is for a threat event. An increase in pollen in the air is an event that is not a threat, yet pollen may be detected and set off alarms in other systems that are not capable of identifying this type of event to avoid triggering an alarm (which would be a false indication of a threat). An increase in pollen levels may cause a slow increase in particulate concentration among the nodes 36, which over the time period increases the mean value of the distribution. However, since pollen is pervasive in the air at all the nodes 36, the variation of the distribution remains constant or changes very little of the time period. In this case, the controller 28 takes no responsive action.

Figure 7:
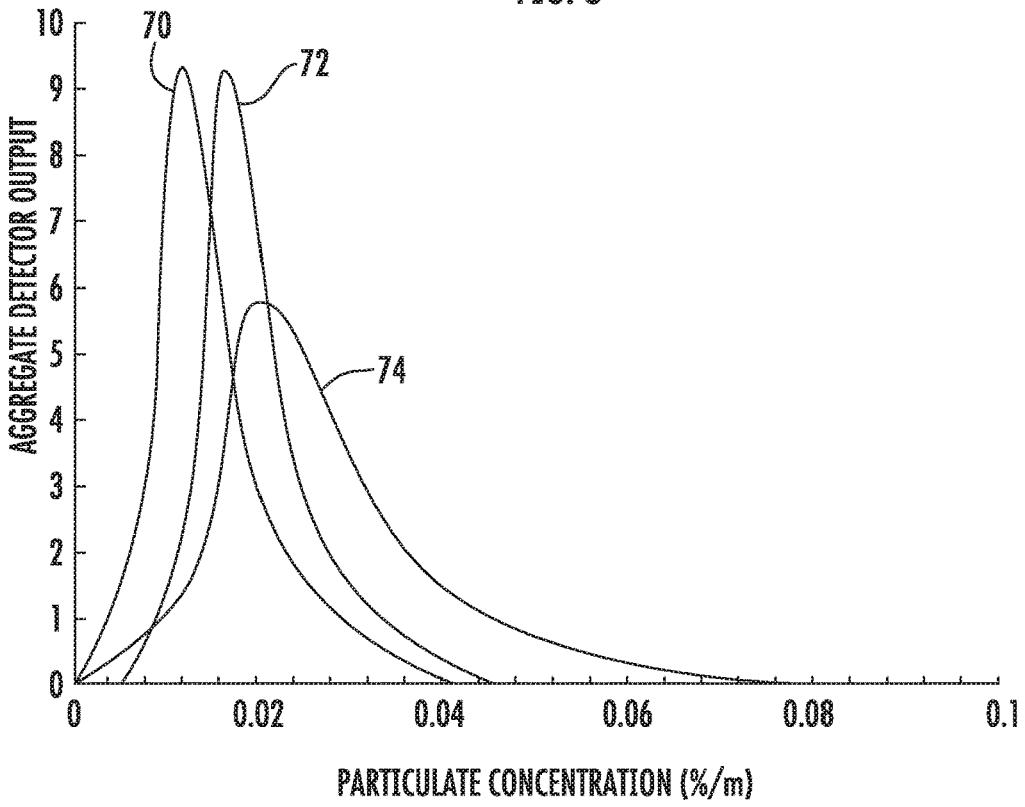
FIG. 7 illustrates an example graph having distributions of aggregate sensor signals, to demonstrate an example control strategy.

FIG. 7 graphically depicts such an event and the affect to increase the mean value of the distribution. FIG. 13 shows distributions 70 and 72 of aggregate sensor output versus particulate concentration. The distribution 70 represents a no-threat condition, i.e., a background condition. The distribution 72 represents the aggregate at a later time and is shifted to the right compared to distribution 70. The shift to the right indicates an increase in the mean value (at the peaks). The breadth of the distributions is representative of the variability. Here the variability of the distributions 70 and 72 is substantially identical, as both distributions 70 and 72 are relatively narrow bell curves.

The second scenario to demonstrate an example of the third approach relates to a slow-moving threat event. A slow-smoldering burning event or a bio-agent release may also cause a slow increase in particulate concentration among the nodes 36. However, this type of event has a different affect on the distribution. Like the pollen, the particulate from the burning or the bio-agent increases the mean value of the distribution over the time period. But since the particulate emanates from the site of the smoldering or the bio-agent emanates from the point of release, the concentration among the nodes 36 is likely to differ. Nodes 36 that are closer to the site or release point are likely to have higher concentrations. As a result, not only does the mean value of the distribution increase, but the variation of the distribution increases. In this case, the controller 38 triggers an alarm in response to identifying an increase in the mean value and an increase in the variability. In this manner, the controller 38 discriminates between harmless events, such as increases in pollen levels which increase the mean but do not change the variability of the distribution, and potential threat events, such as the smoldering burning or bio-agent dispersal which increase the mean and also increase the variability of the distribution.

FIG. 7 depicts an increase in the mean and the variability. FIG. 13 shows a distribution 74 of aggregate sensor output versus particulate concentration that is representative of a smoldering burning or bio-agent release event. The distribution 74 represents the aggregate at a later time than the distribution 70 (the background condition) and is shifted to the right compared to distribution 70. The shift to the right indicates an increase in the mean value (at the peaks). The variability of the distributions 70 and 74 is substantially different, as distribution 70 is a narrow bell curve and the distribution 74 is a wide bell curve.

In another example, the detection network of the detectors 32 may be used to identify whether an identified target species is moving or spreading. For instance, a cloud of a target species may envelop several of the detectors 32, but not others of the detectors 32. The controller 28 identifies that at the instant time there is target species at some detectors 32 but not others. At a later time, the controller 28 identifies that, in addition to the same detectors 32 that identified the target species at the prior time, there are now additional detectors 32 that identify the target species. From this pattern, and especially (but not only) when the detectors 32 with new additional readings of target species are proximate to detectors 32 that at the prior time detected a target species, the controller 28 makes the determination that the target species is spreading. Similarly, if at the later time the controller 28 instead identifies that there are now additional detectors 32 that identify the target species but that the prior detectors 32 that identified the target species no longer identify the target species, the controller 28 makes the determination that the target species is moving but not expanding.

In a further example, the detectors 32 may scan an analyte over a wavelength range to provide a temporal spectra of intensity versus wavelength that can be used to determine a chemical identity of a species. The controller 28 may use the spectra from different detectors 32 to discriminate species and identify whether the same or different species is detected at each detector 32. The controller 28 may also use the spectra from different detectors 32 to verify presence of a species. For instance, if one detector 32 detects species A, the controller 28 may determine that the detection of species A is be a false positive unless another detector 32 also detects species A.

In another example, the operation of the detectors 32 may be modified based on presence of a target species detected by one or more of the detectors 32. For instance, the detectors 32 may operate in a first, presence mode in which the detectors 32 use a single wavelength or wavelength range to simply detect whether a target species is present in the analyte. Once one or more of the detectors 32 detect a presence, the controller 28 may command the detectors 32 to operate in a second, identification mode in which the detectors 32 scan the analyte over a wavelength range to determine the chemical identity of the species.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A detection system comprising:

a host detection system including at least one primary hazard detector and a controller connected for communication with the at least one primary hazard detector;

at least one portable auxiliary hazard detector that can be temporarily introduced in a vicinity of the host detection system and link with the controller of the host detection system to provide additional detection capability, the at least one portable auxiliary hazard detector having at least one light source, each said light source, when operated, emitting a light beam, and at least one photosensor operable to emit sensor signals responsive to interaction of the light beam with an analyte; and a surface plasmon sensor operable to emit second sensor signals responsive to interaction of the light beam with the surface plasmon sensor, the surface plasmon sensor including a prism.

2. The system as recited in claim 1, further comprising a beam splitter operable to split the light beam into first and second secondary light beams, the first secondary light beam being directed at the prism and the second secondary light beam being directed external to the at least one portable auxiliary hazard detector.

3. The system as recited in claim 1, wherein the at least one light source includes an ultraviolet light source and a visible light source.

4. The system as recited in claim 1, further comprising a wireless transmitter operable to transmit the sensor signals to the controller.

5. The system as recited in claim 1, further comprising a universal serial bus (USB) connector and a circuit board connected with the USB connector, wherein the at least one light source and the at least one photosensor are mounted on the circuit board.

6. The system as recited in claim 5, wherein the surface plasmon sensor is mounted on the circuit board.

7. The system as recited in claim 1, further comprising a waterproof casing enclosing the at least one light source and the at least one photosensor.

8. A detector comprising:

a portable auxiliary hazard detector that can be temporarily introduced in a vicinity of a host detection system and link with a controller of the host detection system to provide additional detection capability, the portable auxiliary hazard detector having at least one light source, each said light source, when operated, emitting a light beam, at least one photosensor operable to emit sensor signals responsive to interaction of the light beam with an analyte, and a surface plasmon sensor operable to emit second sensor signals responsive to interaction of the light beam with the surface plasmon sensor, the surface plasmon sensor including a prism.

9. The detector as recited in claim 8, further comprising a beam splitter operable to split the light beam into first and second secondary light beams, the first secondary light beam being directed at the prism and the second secondary light beam being directed external to the at least one portable auxiliary hazard detector.

10. The detector as recited in claim 8, further comprising a universal serial bus (USB) connector and a circuit board connected with the USB connector, wherein the at least one light source, the at least one photosensor, and the surface plasmon sensor are mounted on the circuit board.

11. The detector as recited in claim 8, wherein the at least one light source includes an ultraviolet light source and a visible light source.

12. The detector as recited in claim 8, further comprising a wireless transmitter operable to transmit the sensor signals to the controller.

13. The detector as recited in claim 8, further comprising a waterproof casing enclosing the at least one light source and the at least one photosensor.

14. A detector comprising:

a universal serial bus (USB) connector;

a circuit board connected with the USB connector;

at least one light source mounted on the circuit board, each said light source, when operated, emitting a light beam;

at least one photosensor mounted on the circuit board, each said photosensor operable to emit sensor signals responsive to interaction of the light beam with an analyte; and a surface plasmon sensor mounted on the circuit board and operable to emit second sensor signals responsive to interaction of the light beam with the surface plasmon sensor, the surface plasmon sensor including a prism.

15. The detector as recited in claim 14, further comprising a beam splitter operable to split the light beam into first and second secondary light beams, the first secondary light beam being directed at the prism and the second secondary light beam being directed external to the at least one portable auxiliary hazard detector.

16. The detector as recited in claim 14, wherein the at least one light source includes an ultraviolet light source and a visible light source, and further comprising a wireless transmitter mounted on the circuit board and operable to transmit the sensor signals to the controller.

17. The detector as recited in claim 16, further comprising a waterproof casing enclosing the at least one light source and the at least one photosensor.

18. A method comprising:

introducing a plurality of portable auxiliary hazard detector into a region and linking the portable auxiliary hazard detectors with a controller to provide detection capability in the region, each said portable auxiliary hazard detector having at least one light source, each said light source, when operated, emitting a light beam, and at least one photosensor operable to emit sensor signals responsive to interaction of the light beam with an analyte;

determining whether a target species is present in the analyte based the sensor signals; and determining a chemical identity of the target species from a spectrum using the sensor signals of one of the detectors, and verifying the chemical identity by comparing the spectrum to another spectrum from the sensor signals of another of the detectors.

19. The method as recited in claim 18, wherein the determining whether the target species is present in the analyte is based on an aggregate of the sensor signals from at least two of the portable auxiliary hazard detectors.

20. The method as recited in claim 18, further comprising determining whether the target species is moving or spreading based on the sensor signals.

21. The method as recited in claim 18, further comprising changing operation of a heating, ventilation, and air conditioning system in the region based upon a determination that the target species is present.

22. The method as recited in claim 18, further comprising determining whether there is a trend of increasing concentrations of the target species across two or more of the detectors, and triggering an alarm is there is the trend.

23. The method as recited in claim 18, further comprising determining a mean value and variability of a concentration of the target species across the detectors based on an aggregate distribution of the sensor signals, and triggering an alarm if both the mean value and the variability increase.

24. The method as recited in claim 18, further comprising increasing a sampling rate in one of the portable auxiliary hazard detectors based on a determination from another of the portable auxiliary hazard detectors that the target species is present.

25. The method as recited in claim 24, including increasing the sampling rate only in one or more of the portable auxiliary hazard detectors that are nearest to the portable auxiliary hazard detector that detected the target species, wherein one or more of the portable auxiliary hazard detectors that are remote do not change sampling rate.

* * * * *